US008925524B2

(12) United States Patent
Cooke

(10) Patent No.: US 8,925,524 B2
(45) Date of Patent: Jan. 6, 2015

(54) FUEL INJECTOR

(75) Inventor: Michael Peter Cooke, Gillingham (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 517 days.

(21) Appl. No.: 13/376,649

(22) PCT Filed: May 20, 2010

(86) PCT No.: PCT/EP2010/057003

§ 371 (c)(1),
(2), (4) Date: Dec. 7, 2011

(87) PCT Pub. No.: WO2010/145911

PCT Pub. Date: Dec. 23, 2010

(65) Prior Publication Data

US 2012/0080011 A1 Apr. 5, 2012

(30) Foreign Application Priority Data

Jun. 15, 2009 (EP) ..... 09162669

(51) Int. Cl.

| | |
|---|---|
| ***F02M 51/00*** | (2006.01) |
| ***F02M 45/08*** | (2006.01) |
| ***F02M 47/02*** | (2006.01) |
| ***F02M 51/06*** | (2006.01) |
| ***F02M 61/18*** | (2006.01) |

(52) U.S. Cl.

CPC ..... *F02M 45/086* (2013.01); *F02M 47/027* (2013.01); *F02M 51/061* (2013.01); *F02M 61/182* (2013.01); *F02M 2200/46* (2013.01)

USPC ..... 123/472; 123/445; 123/490; 239/585.1

(58) Field of Classification Search

CPC ..... F02M 45/08; F02M 47/02; F02M 51/06; F02M 61/18

USPC ..... 123/472, 478, 490, 499; 239/585.1, 239/585.5

See application file for complete search history.

(56) References Cited

U.S. PATENT DOCUMENTS

| | | | |
|---|---|---|---|
| 4,546,739 | A | 10/1985 | Nakajima et al. |
| 7,398,763 | B2 | 7/2008 | Gibson et al. |

(Continued)

FOREIGN PATENT DOCUMENTS

| | | | |
|---|---|---|---|
| CN | 1693696 | A | 11/2005 |
| CN | 101305180 | A | 11/2008 |

(Continued)

OTHER PUBLICATIONS

International Search Report dated Aug. 19, 2010.

(Continued)

*Primary Examiner* — Stephen K Cronin
*Assistant Examiner* — Xiao Mo
(74) *Attorney, Agent, or Firm* — Thomas N. Twomey

(57) ABSTRACT

A fuel injector includes a nozzle body with a nozzle bore, a first valve needle received within the nozzle bore and being engageable with a first seat region to control fuel delivery through a first set of nozzle outlets, and a second valve needle received within a valve bore provided in the first valve needle and being engageable with a second seat region arranged to control fuel delivery through a second set of nozzle outlets. A control chamber for fuel is provided between the first valve needle and the second valve needle, wherein movement of the first valve needle is responsive to fuel pressure in the control chamber, and wherein movement of the second valve needle is mechanically coupled to an armature of the first actuator arrangement. A second actuator arrangement controls movement of the first valve needle by controlling fuel flow into the control chamber.

17 Claims, 8 Drawing Sheets

(56) References Cited

U.S. PATENT DOCUMENTS

| | | | |
|---|---|---|---|
| 2009/0134246 | A1 | 5/2009 | Cooke et al. |
| 2009/0277423 | A1 | 11/2009 | Cooke |
| 2010/0070158 | A1 | 3/2010 | Fukonagane et al. |

FOREIGN PATENT DOCUMENTS

| | | | | |
|---|---|---|---|---|
| DE | 102004015746 | A1 | 10/2005 | |
| EP | 1650427 | A1 | 4/2006 | |
| EP | 2050951 | | 4/2009 | |
| EP | 2050951 | A1 * | 4/2009 | ..... F02M 47/06 |
| JP | 2007-239735 | | 9/2007 | |
| WO | 2008/056225 | | 5/2008 | |
| WO | WO 2008056225 | A1 * | 5/2008 | ..... F02M 45/08 |

OTHER PUBLICATIONS

English Translation of 1st Japan Office Action dated May 24, 2013.

* cited by examiner

FUEL INJECTOR

TECHNICAL FIELD

The invention relates to a fuel injector for use in the delivery of fuel to a combustion space of an internal combustion engine. In particular, the invention relates to a fuel injector of the type intended for use in a so-called 'common rail' compression ignition internal combustion engine system.

BACKGROUND OF THE INVENTION

In an internal combustion engine, it is known for a fuel pump to supply fuel to a high-pressure accumulator (or common rail), from which it is delivered into each cylinder of the engine by means of a dedicated fuel injector. Typically, a fuel injector has an injection nozzle which is received within a bore provided in a cylinder head of the cylinder; and a valve needle which is actuated to control the release of high-pressure fuel into the cylinder from spray holes provided in the nozzle.

Historically common rail fuel injectors have opened and closed the needle by way of a hydraulic servo mechanism (e.g. a power assistance), such as that described in EP 0647780 or EP 0740068.

A solenoid-actuated hydraulic servo fuel injector such as that of EP 0740068 is illustrated in FIG. 1. The fuel injector 1 comprises a valve body 3 defining a blind bore 5 that terminates at a nozzle region 7; and an elongate valve needle 9 having a tip region 11 that is slidable within the bore 5, such that the tip 11 can engage and disengage a valve seat 13 defined by an inner surface of the nozzle 7. The nozzle 7 is provided with one or more apertures (or spray holes; not shown) in communication with the bore 5. Engagement of the tip 11 with the valve seat 13 prevents fluid escaping from the valve body 3 through the apertures, and when the tip 11 is lifted from the valve seat 13, fluid may be delivered through the apertures into an associated engine cylinder (not shown).

Although not show clearly in FIG. 1, the valve needle 9 is shaped such that the region that extends between the gallery 15 and the nozzle 7 is of smaller diameter than the bore 5 to permit fluid to flow between the valve needle 9 and the inner surface of the valve body 3. An annular gallery 15 is provided within the valve body 3. The gallery 15 communicates with a fuel supply line 17 arranged to receive high-pressure fuel from an accumulator of an associated fuel delivery system. In order to permit fuel to flow from the gallery 15 towards the nozzle 7, the valve needle 9 is provided with a fluted region 19 which also acts to restrict lateral movement of the valve needle 9 within the valve body 3.

A chamber 21 is provided within the valve body 3 at a position remote from the nozzle 7, the chamber 21 communicating with the high pressure fuel line 17 through a restrictor 23. The chamber 21 is closed by a plate 25. The end of the valve needle 9 remote from the tip 11, is provided with a reduced diameter projection 27, the projection 27 guiding a compression spring 29 which is engaged between the valve needle 9 and the plate 25 to bias the valve needle 9 to a position in which the tip 11 engages the valve seat 13.

A body 31 engages the side of the plate 25 opposite that engaged by the valve body 3, the body 31 and plate 25 together defining a chamber 33 which communicates with the chamber 21 through an aperture 35. The body 31 is provided with a bore within which a valve member 37 is slidable. The valve member 37 comprises a cylindrical rod provided with an axially extending blind bore, the open end of the bore being able to communicate with the chamber 33 when the valve member 37 is lifted such that the end thereof is spaced from the plate 25, such communication being broken when the valve member 37 engages the plate 25. A pair of radially extending passages 39 communicate with the blind bore adjacent the blind end thereof, the passages 39 communicating with a chamber which is connected to a suitable low pressure drain.

The body 31, plate 25 and valve body 3 are mounted on a nozzle holder 41 by means of a cap nut 43. The nozzle holder 41 includes a recess within which a solenoid actuator 45 is provided.

The valve member 37 carries an armature such that upon energisation of the solenoid actuator 45, the armature and valve member 37 are lifted so that the valve member 37 disengages the plate 25. On de-energising the solenoid actuator 45, the valve member 37 returns to its original position under the action of a spring 47.

In use, the valve needle 9 is biased by the spring 29 such that the tip 11 engages the valve seat 13 and, thus, delivery of fuel from the apertures does not occur. In this position, the pressure of fuel within the chamber 21 is high, and hence the force acting against the end of the valve needle 9 due to the fuel pressure, and also due to the resilience of the spring 29 is sufficient to overcome the upward force acting on the valve needle 9 due to the high pressure fuel acting against the angled surfaces of the valve needle 9.

In order to lift the tip 11 of the valve needle 9 away from the valve seat 13 to permit fuel to be delivered from the apertures, the solenoid actuator 45 is energised to lift the valve member 37 against the action of the spring 47 such that the end of the valve member 37 is lifted away from the plate 25. The lifting of the valve member 37 permits fuel from the chamber 33 and hence the chamber 21 to escape to drain through the bore of the valve member 37 and passages 39. The escape of fuel from the chamber 21 reduces the pressure therein, and due to the provision of the restrictor 23, the flow of fuel into the chamber 21 from the fuel supply line 17 is restricted. As the pressure within the chamber 21 falls, a point will be reached at which the force applied to the valve needle 9 due to the pressure within the chamber 21 in combination with that applied by the spring 29 is no longer sufficient to retain the tip 11 of the valve needle 9 in engagement with the valve seat 13, and hence a further reduction in pressure within the chamber 21 will result in the valve needle 9 being lifted to permit fuel to be delivered from the apertures. Typically, a 20% reduction in pressure within the chamber 21 is sufficient to cause the tip 11 of the valve needle 9 to lift from the valve seat 13 and for a fuel injection from the apertures to commence.

In order to terminate delivery, the solenoid actuator 45 is de-energised and the valve member 37 moves downwards under the action of the spring 47 until the open end engages the plate 25. This movement of the valve member 37 breaks the communication between the chamber 33 and the drain and, hence, the pressure within the chamber 33 and chamber 21 will increase. Eventually a point is reached at which the force applied to the valve needle 9 due to the pressure within the chamber 21 and the spring 29 exceeds that tending to open the valve needle 9, and the valve needle 9 will then move to a position in which the tip 11 engages the valve seat 13 to prevent further delivery of fuel.

A solenoid-actuated hydraulic servo mechanism such as that of FIG. 1 means that a low force control valve 37 can be used to switch the high forces on the valve needle 9. With low forces on the control valve 37, a relatively inexpensive and simple solenoid can give a suitably fast enough response in the injector for most purposes. However, a number of disadvantages are associated with the design of such servo injector mechanisms. In this regard, prior art servo designs are subject to a lag period between energisation of the solenoid and commencement of the fuel injection event, during which a parasitic flow of fuel is channelled to a low-pressure fuel drain. Therefore, a hydraulic servo injector cannot always be made to commence a fuel injection event as quickly as may be desired. Moreover, the faster the response desired, the higher the fuel flows required for the hydraulic servo and the higher the resulting parasitic losses from the servo mechanism. The parasitic fuel flow also undesirably returns heat to the fuel supply.

More recently some injectors have used a piezoelectric actuator to directly move the needle (e.g. EP 0995901; EP 1174615). These designs eliminate both the parasitic losses from the servo flows and the time delays in the servo. Some of them also have an accumulator volume within the injector which ensures that maximum pressure is available at the nozzle seat and that wave activity (which could interfere with multiple injections) is minimised.

As illustrated in FIG. 2, a known piezoelectrically actuated fuel injector may comprise a valve body 3 having a blind bore 5 extending into a nozzle region 7 provided with a plurality of apertures (or fuel spray holes; not shown); and a valve needle 9 reciprocable within the bore 5 between injecting and non-injecting positions, as previously described. A piezoelectric actuator stack 49 is operable to control the position occupied by a control piston 51, the piston 51 being moveable to control the fuel pressure within a control chamber 53 defined by a surface associated with the valve needle 9 of the injector and a surface of the control piston 51. The piezoelectric actuator stack 49 comprises a stack of piezoelectric elements, the energisation level, and hence the axial length, of the stack being controlled by applying a voltage across the stack. Upon de-energisation of the piezoelectric stack 49, the axial length of the stack is reduced and the control piston 51 is moved in a direction which causes the volume of the control chamber 53 to be increased, thereby causing fuel pressure within the control chamber 53 to be reduced. The force applied to the valve needle 9 due to fuel pressure in the control chamber 53 is thus reduced, causing the valve needle 9 to lift away from a valve needle seating (not shown) under the influence of high-pressure fuel on surfaces of the valve needle 9, so as to permit fuel delivery into an associated engine cylinder via one or more apertures (or spray holes; not shown).

In order to cause initial movement of the valve needle 9 away from its seating, a relatively large retracting force must be applied to the valve needle 9 to overcome the downwards (closing) force on the valve needle 9. Typically, the large retracting force applied to the valve needle 9 is maintained throughout the opening movement, until the valve needle 9 reaches its full lift position. However, in theory, once valve needle 9 movement has been initiated, a reduced force is sufficient to cause continued movement of the valve needle 9 towards its full lift position. Hence, many known fuel injectors of this type are relatively inefficient as a significant amount of energy is wasted in applying a large retracting force to the valve needle 9 throughout its full range of movement.

To terminate a fuel injection event, the stack 49 is returned to its initial energisation state, and as a result, the piston 51 also returns substantially to its initial position thereby reducing the volume of the control chamber 53. The consequential increase in fuel pressure within the control chamber 53 applies an increased closing force on the valve needle 9, and a point is eventually reached at which the fuel pressure within the control chamber 53 in conjunction with the spring 29 is sufficient to return the needle 9 into engagement with the valve seating (not shown).

In the piezoelectric fuel injector illustrated in FIG. 2, the control piston 51 is part of a hydraulic amplifier system situated between the actuator stack 49 and the needle 9, such that axial movement of the actuator 49 results in an amplified axial movement of the needle 9. In contrast to the fuel injector illustrated in FIG. 2, some piezoelectrically-actuated fuel injectors may be of the type in which energisation (rather than de-energisation) of the piezoelectric stack is required to initiate a fuel injection event.

In addition to the potential faster injector response time of the piezoelectrically operated valve, a further benefit of using a piezoelectric actuator for direct control over the movement of a valve needle is that the axial length of the piezoelectric stack can be variably controlled by changing the amount of electrical charge stored on the piezoelectric stack and, therefore, it is possible to control the position of the valve needle relative to the valve seat. In this way, piezoelectric fuel injectors offer greater ability to meter the amount of fuel that is injected.

However, a number of disadvantages of direct-acting piezoelectric fuel injectors are also apparent. For example, one problem with these direct acting designs is that a relatively large and expensive piezoelectric actuator is needed to provide the energy needed to lift the needle. Furthermore, this type of actuator needs to get larger and/or more efficient as nozzle flow requirements and pressures increase. Another consideration with respect to large fuel injections is that the amount of needle lift is limited by the capabilities of the actuator (even if a hydraulic amplifier is used to try to alleviate this problem).

The invention relates to a fuel injector and to a method for operating a fuel injector so as to overcome or at least alleviate at least one of the above-mentioned problems in the prior art.

SUMMARY OF THE INVENTION

In broad terms, the invention provides a fuel injector that achieves benefits of direct-acting and hydraulic servo fuel injector designs, while reducing disadvantages associated with such known systems.

Accordingly, the invention provides a fuel injector for use in an internal combustion engine comprising an injection nozzle having a nozzle body provided with a nozzle bore, a first valve needle received within the nozzle bore and being engageable with a first seat region to control fuel delivery through a first set of nozzle outlets, and a second valve needle received within a valve bore provided in the first valve needle and being engageable with a second seat region to control fuel delivery through a second set of nozzle outlets. A control chamber for fuel is preferably defined, at least in part, between the first valve needle and the second valve needle, and movement of the first valve needle is responsive to fuel pressure in the control chamber, whereas movement of the second valve needle is coupled to a first actuator arrangement, such that when the second valve needle lifts away from the second seating region, a fuel flow path is established between the control chamber and the second set of nozzle outlets. The fuel injector further includes a second actuator arrangement that is operable to control fuel flow into the control chamber thereby regulating fuel pressure within the control chamber and, thus, movement of the first valve needle.

A benefit of the invention is that it provides the advantages of a direct-acting fuel injector, namely speed of operation, but at a lower cost and without the limitations on fuel pressure and fuel flow rate. Furthermore, the invention provides the advantage of a so-called VON (variable orifice nozzle) of selective operation of either the second valve needle alone, or operation of both the first and second valve needles together, thereby providing a flexible injection characteristic.

It should be noted that the first and second valve needles are controlled in different ways: the position of one of the valve needles being controlled directly by way of an actuating mechanism, and the position of the other being controlled indirectly by way of a servo flow. So, in order to enable fast response of the second valve needle, the second valve needle may be arranged to have a mechanical coupling with an armature of the first actuator arrangement. Thus, movement of the armature results in immediate disengagement of the second valve needle from its seat region such that fuel flow is may be established from the control chamber to the second set of nozzle outlets. Subsequent pressure drop in the control chamber determines movement of the first valve needle.

In this way, one or more advantages over the prior art may be achieved, for example: the servo flow is no-longer parasitic as it is injected; servo flows can be relatively large as they are doing useful work, so response speed can be high; no back-leak connection to the fuel supply is required on the injector and no heat is returned to the fuel supply; small injections are controlled directly and so are not subject to servo lags; needle lift for large injections is not limited by actuator capabilities.

In order to enable pressurised fuel to fill the control chamber, the second valve needle may be provided with a fuel flow passage to permit fuel to flow from an accumulator volume to the control chamber.

Suitably, the fuel flow passage comprises multiple drillings. For example, a restricted drilling may be provided to permit fuel to flow from the accumulator volume into an axial drilling provided in the inner valve member. Such a restricted drilling provides fuel flow into the control chamber at a restricted rate to ensure a sufficient pressure drop in the control chamber such that the first valve needle will lift away from its seating region. Also, the axial drilling may also include an open end having a seating surface against which a valve member is engageable under the control of the second actuator arrangement. Such an arrangement provides a substantially unrestricted flow of fuel into the control chamber which keeps the chamber pressurised, in another operational mode, such that the first valve needle is caused to remain in engagement with its seat region. Thus, it will be appreciated that the energisation state of the second actuator arrangement determines whether fuel delivery occurs through the first set of nozzle outlets only or, alternatively, through the first and second set of nozzle outlets.

In one embodiment, the nozzle body bore is provided with a plug member which defines, at least in part, the control chamber together with the first valve needle. The plug member may also be provided with an aperture for slidably receiving a part of the second valve needle.

In an advantageous embodiment, the actuator arrangements comprise solenoid actuators. In this embodiment, the second valve member is suitably coupled to an armature responsive to the energisation state of the solenoid actuator. The armature may be received within the accumulator volume, and is conveniently coupled to the second valve member via the control piston.

The invention also relates to an internal combustion engine having a fuel injector in accordance with the invention therein.

It will be understood that by the term "nozzle outlets" it is meant the holes (or apertures) through which fuel is injected from the injection nozzle of the fuel injector and into an associated engine cylinder (in use), which may also be referred to as injection holes, spray holes or similar terms known in the art. By "a set of nozzle outlets" it is meant the one or more nozzle outlets through which fuel is injected when a particular valve needle is disengaged from an associated seating region. Thus, in the context of the invention, each valve needle is associated with a seating region and an associated "set" of nozzle outlets.

The invention also resides in a method of operating an injector as described above, including, in a first fuel injection mode, activating the second actuator arrangement prior to an injection event so as to provide a substantially unrestricted fuel flow path into the control chamber, and activating the first actuator arrangement in order to deliver pressurised fuel through the first set of nozzle outlets only.

The invention may include, in a second injecting mode, holding the second actuator arrangement in a de-activated state to provide a restricted flow path for fuel to the control chamber, activating the first actuator arrangement in order to deliver pressurised fuel through the first set of nozzle outlets, activating the second actuator arrangement a predetermined amount of time after activation of the first actuator arrangement in order to engage the first valve needle with the first seat region, and deactivating the first actuator arrangement a predetermined amount of time after activating the second actuator arrangement in order to engage the second valve needle with the second seat region at substantially the same time as the first valve needle engages with the first seat region.

These and other aspects, objects and the benefits of this invention will become clear and apparent on studying the details of this invention and the appended claims.

BRIEF DESCRIPTION OF THE DRAWINGS

Reference has already been made to FIGS. 1 and 2, which show known injector arrangements. In order that the invention may be better understood, it will now be described, by way of example only, with reference to the accompanying drawings, in which.

DETAILED DESCRIPTION OF THE INVENTION

Figure 1:
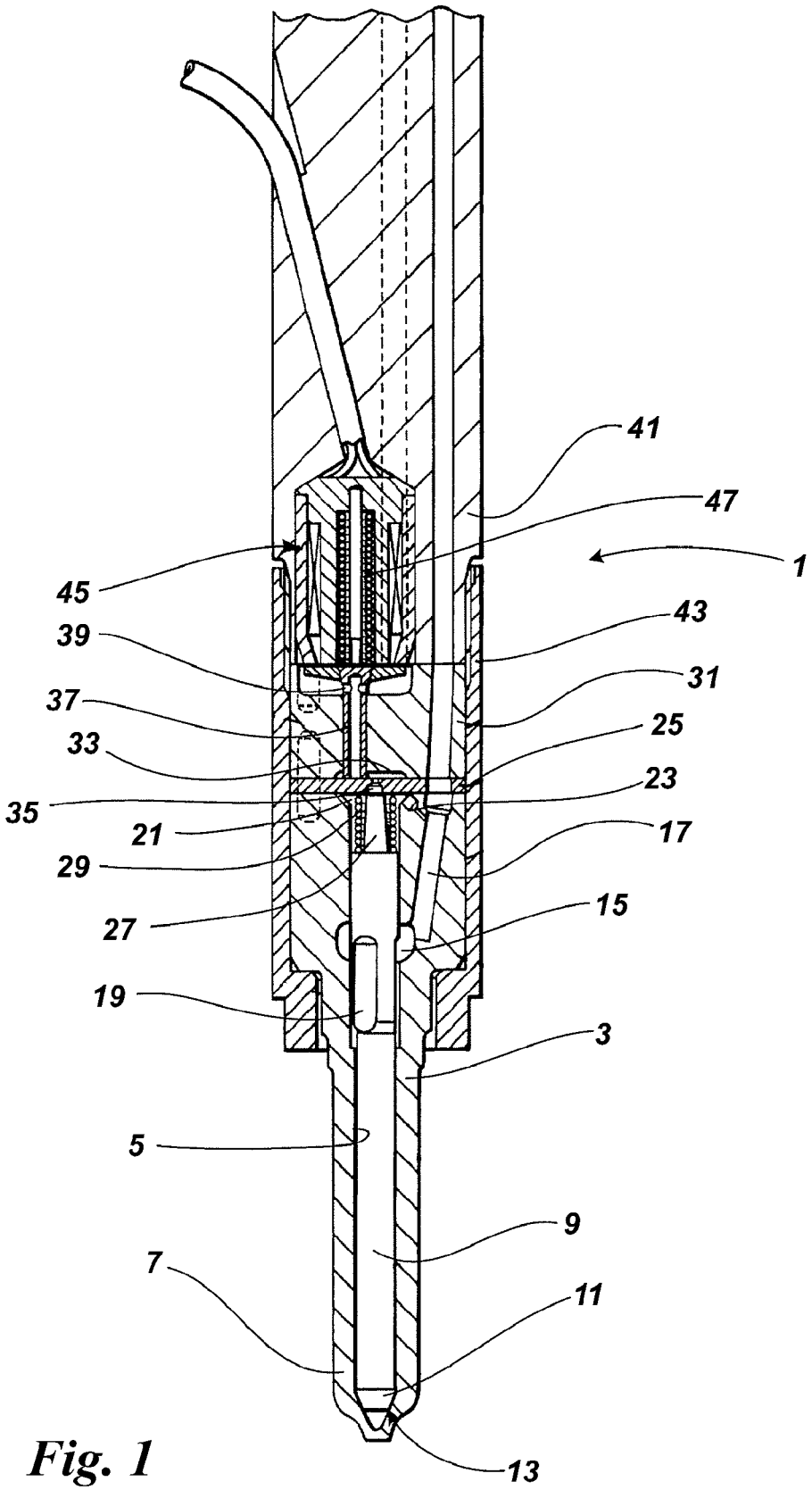
Fig. 1 PRIOR ART
Figure 2:
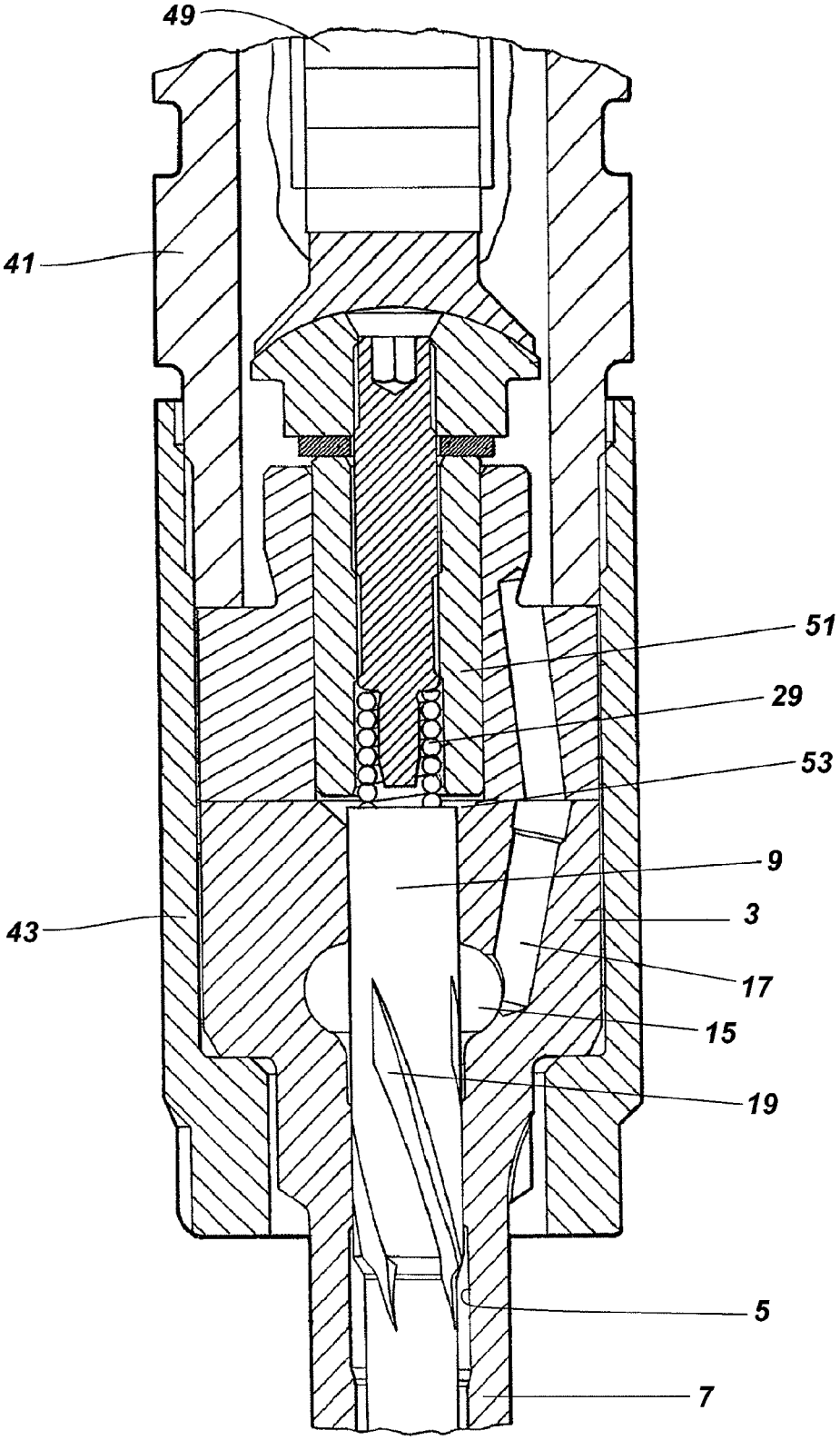
Fig. 2 PRIOR ART
Figure 3:
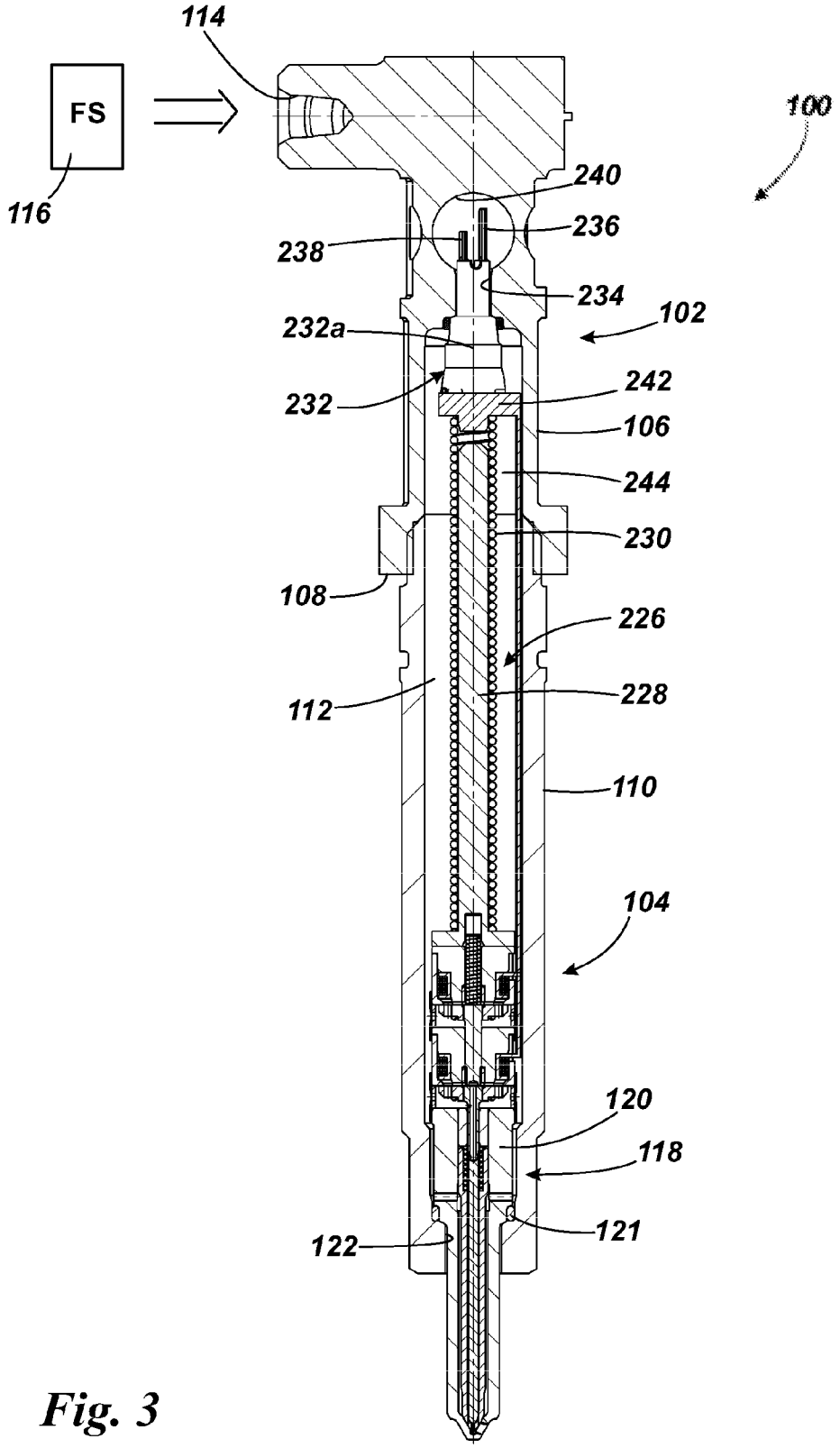
FIG. 3 is a side view, in cross-section, of a fuel injector in accordance with the invention.
Figure 4:
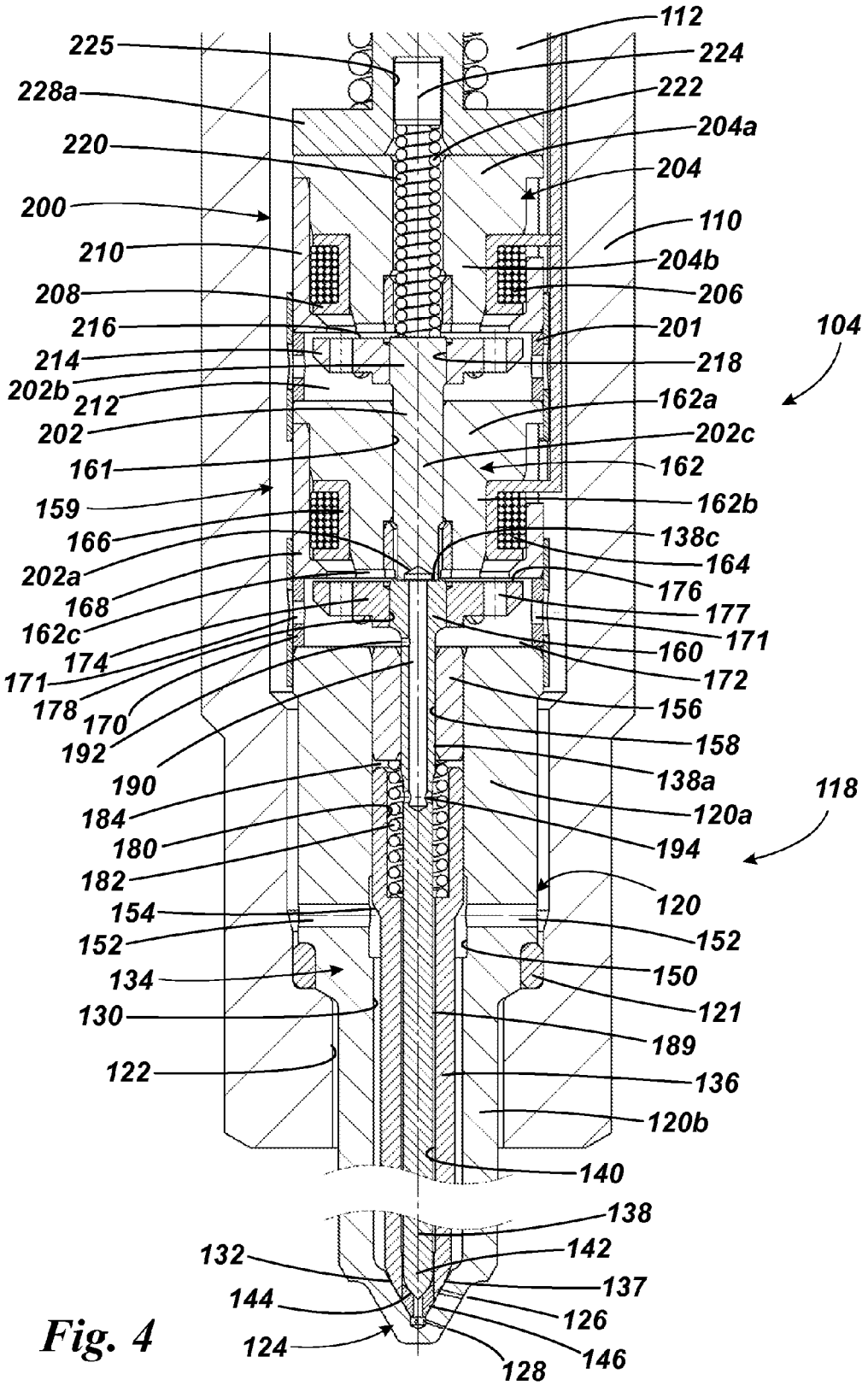
FIG. 4 is an enlarged side view, in cross section, of a portion of the fuel injector of FIG. 3.

Referring to FIGS. 3 and 4, a fuel injector 100 is generally elongate in form and includes a nozzle holder 102 (the upper end of the injector in the orientation shown in the figures) and a cap nut 104 connected to a lower end of the nozzle holder 102. More specifically, the nozzle holder 102 includes a downwardly depending tubular portion 106 defining an open end 108 which cooperates by way of a screw thread arrangement with an open upper end of a tubular wall 110 of the cap nut 104. The internal surfaces of the tubular walls of the nozzle holder 102 and the cap nut 104 define an elongate cylindrical chamber 112 for housing the operating components of the fuel injector 100, as will be described further herein.

A fuel inlet socket 114 is provided at the upper end of the nozzle holder 102 which connects to a pressurised fuel source (shown schematically as 116), in use. Although not shown in the section view of FIG. 3, a fuel supply line extends from the fuel inlet socket 114 and opens into the injector chamber 112 thus supplying high pressure fuel thereto.

An injection nozzle 118 is housed at the lowermost end of the chamber 112 and includes a nozzle body 120 having a wide diameter region 120*a* located within the chamber 112 and a narrow diameter region 120*b* that projects through an aperture 122 defined in the bottom end of the cap nut 104. An o-ring seal member 121 is positioned at a shoulder defined at the peripheral edge of the aperture 122 and is compressed by the wide diameter region 120*a* of the nozzle body 120 so as to provide a seal against fuel escaping from the injector chamber 112.

The narrow diameter region 120*b* defines a nozzle tip region 124 that is provided with first and second sets of nozzle outlets 126, 128. Although not shown in the figures, in use the tip 124 projects into a combustion cylinder of an engine to deliver pressurised fuel to it through the sets of nozzle outlets 126, 128.

As shown clearly in FIG. 4, the nozzle body 120 is provided with an axially extending blind bore 130, the blind end of which is shaped to define a conical surface 132 in the vicinity of the nozzle tip 124. The nozzle bore 130 houses a nozzle valve arrangement, indicated generally as 134, which includes a first, outer valve member 136 in the form of an elongate needle which defines a sliding clearance with the nozzle bore 130. The tip of the outer valve needle 136 is engageable with a first (outer) seat region 137, which is defined by the conical surface 132 of the nozzle bore 130, to control the delivery of fuel through the first set of nozzle outlets 126.

The valve arrangement also includes a second valve member 138, also in the general form of an elongate valve needle, which is received within a valve bore 140 defined along the longitudinal axis of the first valve needle 136 and defines a sliding fit therewith. The second valve needle 138 has a valve tip 142 which is engageable with a second (inner) seat region 144 which is defined by a valve seat member 146 located at the blind end of the nozzle bore 130.

The valve seat member 146 seals against an annular region of the conical surface 132 of the nozzle bore 130 so that it separates the first set of nozzle outlets 126 from the second set of nozzle outlets 128. This ensures that fuel delivery from the first set of outlets 126 occurs independently from the second set of outlets 128. An additional feature of the valve insert member 146 is that it is shaped with a cylindrical outer profile having a diameter comparable to that of the valve bore 140. Therefore, the valve seat member 146 serves to guide movement of the first valve member 136 as it moves towards and away from the first seat region 137. It should be appreciated that the sliding fit between the valve insert member 146 and the valve bore 140 has a sufficiently small clearance to ensure a sealing engagement thereby substantially preventing fluid communication between the valve bore 140 and the first set of nozzle outlets 126.

Approximately mid-way along the length of the nozzle bore 130, the bore is shaped to define an annular gallery 150 around a mid-section of the outer valve needle 136. Fuel is permitted to enter the annular gallery 150 from the injector chamber 112 via two laterally extending passages 152 that are provided in the relatively wide region 120*a* of the nozzle body 120.

In order to permit high pressure fuel to flow from the gallery 150 to the blind end of the nozzle bore 130, the outer valve needle 136 is shaped with a smaller diameter along the section that extends from the annular gallery 150 to the first seating region 137 so that an annular channel is established between the outer valve needle 136 and the nozzle bore 130. The section of the outer valve needle 136 above the gallery 150 has a larger diameter that defines a sliding fit with the corresponding region of the nozzle bore 130 to ensure that movement of the outer valve needle 136 is closely guided.

An angled step or 'thrust surface' 154 is defined at the mid-point of the outer valve needle 136 where its diameter changes. Pressurised fuel acts on the thrust surface 154 to provide a force on the outer valve needle 136 urging it away from the first seat region 137.

The end of the nozzle bore 130 distil from the blind end receives an insert or 'plug' member 156 that effectively plugs the nozzle bore 130 and retains the outer valve needle 136. The inner valve needle 138 extends along the valve bore 140 and through a through-bore 158 provided in the plug member 156 such that an end portion 160 projects from the plug member 156 and is operatively coupled to an electromagnetic actuator arrangement 159.

The actuator arrangement 159 includes a solenoid core member 162 which is annular in form and has a generally T-shaped cross section so as to define a relatively wide upper core portion 162*a* and a relatively narrow lower core portion 162*b*. A solenoid 164 is formed around the lower core portion 162*b* and mounted on a non-conductive coil former 166 in a known manner. A U-shaped outer pole piece 168 fits over the lower core region 162*b* and provides an outer pole of the actuator arrangement whilst the lower end surface of the core member 162 provides an inner pole. The actuator arrangement 159 is spaced apart from the upper end face of the nozzle body 120 by a shim 170 which defines a volume 172 between the two components. Note that the shim 170 is provided with apertures 171 so that pressurised fuel can enter the volume 172 from the injector chamber 112.

The volume 172 houses a disc-shaped armature 174 that defines a substantially flat upper surface 176 which opposes an underside surface of the actuator arrangement 159. The armature 174 includes vent holes 177 adjacent its periphery, which reduce the hydrodynamic drag of the armature as it moves with in the fluid filled volume 172 and a central aperture 178 for receiving the end portion 160 of the inner valve needle 138 securely, for example by way of a press fit, screw thread connection or by welding. The end portion 160 defines a flat upper face that stands slightly proud of the upper surface 176 of the armature to avoid an electromagnetic short circuit. However, the end portion 160 of the inner valve needle 138 and the armature 174 still present a substantially flat and smooth surface which is beneficial for electromagnetic efficiency.

Note that although it is described here that the end of the inner valve needle is mechanically coupled to the armature 174, the inner valve needle could be a multipart component, one of these components being in some way coupled to the armature.

In the usual manner, the energisation state of the actuator arrangement 159 controls movement of the armature 174 towards and away from the core member 162 thereby controlling the axial position of the inner valve member 138 and, thus, whether the tip region 142 is engaged or disengaged with the second seat region 144 provided by the valve insert member 146.

From the foregoing, it will be appreciated that the axial position, or 'lift', of the inner valve needle 138 is controlled by way of the direct mechanical coupling between it and the armature 174 of the actuator arrangement 159. However, positional control of the outer valve needle 136 is controlled in a different way, as will now be explained.

The end of the outer valve needle 136 remote from the tip region 124 is shaped to provide a deep recess 180 for housing a coil spring 182, which extends from the bottom of the recess 180 around the inner valve needle 138 and bears against the underside surface of the plug member 156, thereby providing a closing force to the outer valve needle 136.

A control chamber 184 is defined between an underside surface of the plug member 156 and the end surface of the outer valve needle 136, in addition to the volume provided by the spring recess 180. Pressurised fuel resides in the control chamber 184 and provides a force on the outer valve needle 136 urging it into engagement with the first seat region 137. It should therefore be appreciated that the axial position of the outer valve needle results from a balance of the forces applied on it by 1) fuel pressure in the gallery 150 acting on the thrust surface, 2) fuel pressure in the control chamber 184 acting on the end surface of the outer valve needle 136, 3) the force due to the spring 182, and 4) the force acting in the outer valve needle 136 in the vicinity of the seat region 137.

In addition to providing a means to control the axial position of the outer valve needle 136, the fuel within the control chamber 184 provides a fuel supply for delivery from the second set of nozzle outlets 128 past the second valve seat region 144. The inner valve needle 138 defines a clearance with the valve bore 140 such that fuel can flow from the control chamber 184 to a point adjacent the second valve seat region 144 along an annular channel 189 defined by the bore clearance.

Fuel supply to the control chamber 184 is provided for by an axial passage 190 in the form of a blind drilling provided in an upper region 138*a* of the inner valve needle 138. The axial drilling 190 extends from the upper end face of the inner valve needle 136 to terminate in the vicinity of the control chamber 184. The upper region 136*a* of the inner valve needle 136 is also provided with a lateral drilling 192 that allows fluid to flow into the axial passage 190 from the armature volume 172 at a restricted rate. Fuel is permitted to flow out of the axial passage 190 into the control chamber 184 by a set of radial passages 194 provided at the blind end of the axial passage 190. A further fuel flow path is provided into the control chamber from the fuel volume 172 via the drilling 190 which opens at the upper end face of the end region 160 of the inner valve member 136. Fluid communication through the open end of the drilling 190 is controlled by a second actuator arrangement 200, as will now be described.

The second actuator arrangement 200 is located axially directly above the first solenoid arrangement (in the orientation shown) and is spaced apart therefrom by a second shim 201. A valve member 202 associated with the actuator arrangement 200 extends through a central aperture 161 provided in the core member 162 of the first actuator arrangement 159 and defines a sealing end 202*a* that is shaped to be sealable against the upper end portion 160 of the inner valve member 136 so as to close off the open end of the drilling 190.

The second actuator arrangement 200 is similar in construction to the first actuator arrangement 159 and includes an annular core member 204 that is generally T-shaped in cross section to define a relatively wide upper region 204*a* and a relatively narrow lower region 204*b*. A solenoid 206 carried on a coil former 208 is received around the lower region 204*b* and a U-shaped pole piece 210 fits over the solenoid 206 and the lower region 204*b* of the core member 204 thereby enclosing the solenoid and providing an outer pole of the actuator, whereas the lower end face of the lower region 204*b* provides an inner pole.

The space between the first and second actuator arrangements 159, 200 defines a second fuel volume 212 which houses a second disc-shaped armature 214, an upper face 216 of which lies adjacent the second actuator arrangement 200. The second armature 214 includes a central aperture 218 within which an upper end 202*b* of the valve member 202 is securely received, for example by way of a press fit or welding.

The upper end 202*b* of the valve member 202 includes a flat upper end face which lies flush with the upper surface 216 of the second armature 214 and a valve stem region 202*c* that depends downwardly and is received in the central aperture 161 of the first core member 162. As mentioned above, the sealing end 202*a* of the valve member 202 is shaped to include a shallow recess thereby defining a downwardly depending outer rim that is engageable with the upper end face 138*c* of the inner valve needle 138, depending on the energisation state of the second actuator arrangement 200.

The valve member 202 is biased into engagement with the inner valve needle 136 by a compression spring 220 that is located in a central aperture 222 of the second core member 204 arrangement and which abuts against the upper end face of the valve member 202. The other end of the compression spring 222 bears against a spring stop 224 received within a drilling 225 provided in a lower end of a locating arrangement 226.

The locating arrangement 226 principally comprises an elongate rod 228 housed within the injector chamber 112 and which is shaped with a flanged lower end 228*a* to bear on the second core member 204 by a biasing spring 230 in order to hold the first and second actuator arrangements 159, 200 in position. The biasing spring 230 is received around the rod 228 and its upper end bears against a connector arrangement 232 that is located at the upper end of the injector chamber 112.

The connector arrangement 232 includes a plug 232*a* of non-conductive material, for example a ceramic such as alumina, zirconia or silicon nitride, that extends through an aperture 234 at the upper ceiling of the injector chamber 112 and provides means to electrically connect the first and second actuator arrangements 159, 200 to an electrical supply. First and second electrical leads 236, 238 extend through the plug 232*a*, ends of which project from the upper end of the plug 232*a* to reside in a connection socket 240 of the nozzle holder 102.

The electrical supply leads 236, 238 project from the lower most end of the plug 232*a* and connect to an overmoulded connector piece 242 which is urged into engagement with the plug 232*a* by the compression spring 230. The connector piece 242 is provided with a conductor lead 244 that extends down the internal surface of the injector chamber 112 and provides an electrical connection to the solenoids 164, 206 of the first and second actuator arrangements 159, 200.

It should be appreciated at this point that although electromagnetic actuators have been described, the injector 100 might also be operated with different types of actuators, for example piezoelectric actuators or magnetorestrictive actuators. For this reason, the injector chamber 112 is relatively large so as to provide flexibility of the type of actuators that can be used, in addition to providing an accumulator volume for pressurised fuel. Since the actuator arrangements described in FIGS. 3 and 4 are relatively small, the locating arrangement 226 provides a means to maintain compression on the actuator arrangements 159, 200 as well as provide an upward force on the connector arrangement 232 to ensure that it forms an effective seal against the aperture 234 to avoid leakage of high pressure fuel from the injector chamber 112. It should be noted that other components and mechanisms by which a relatively small actuator may be securely housed within a relatively large housing volume would be readily apparent to the person skilled in the art, and any such alternative components and mechanisms are encompassed within the scope of the invention as defined by the claims.

Operational modes of the fuel injector will now be described with reference to FIGS. 5 to 8.

Figure 5:
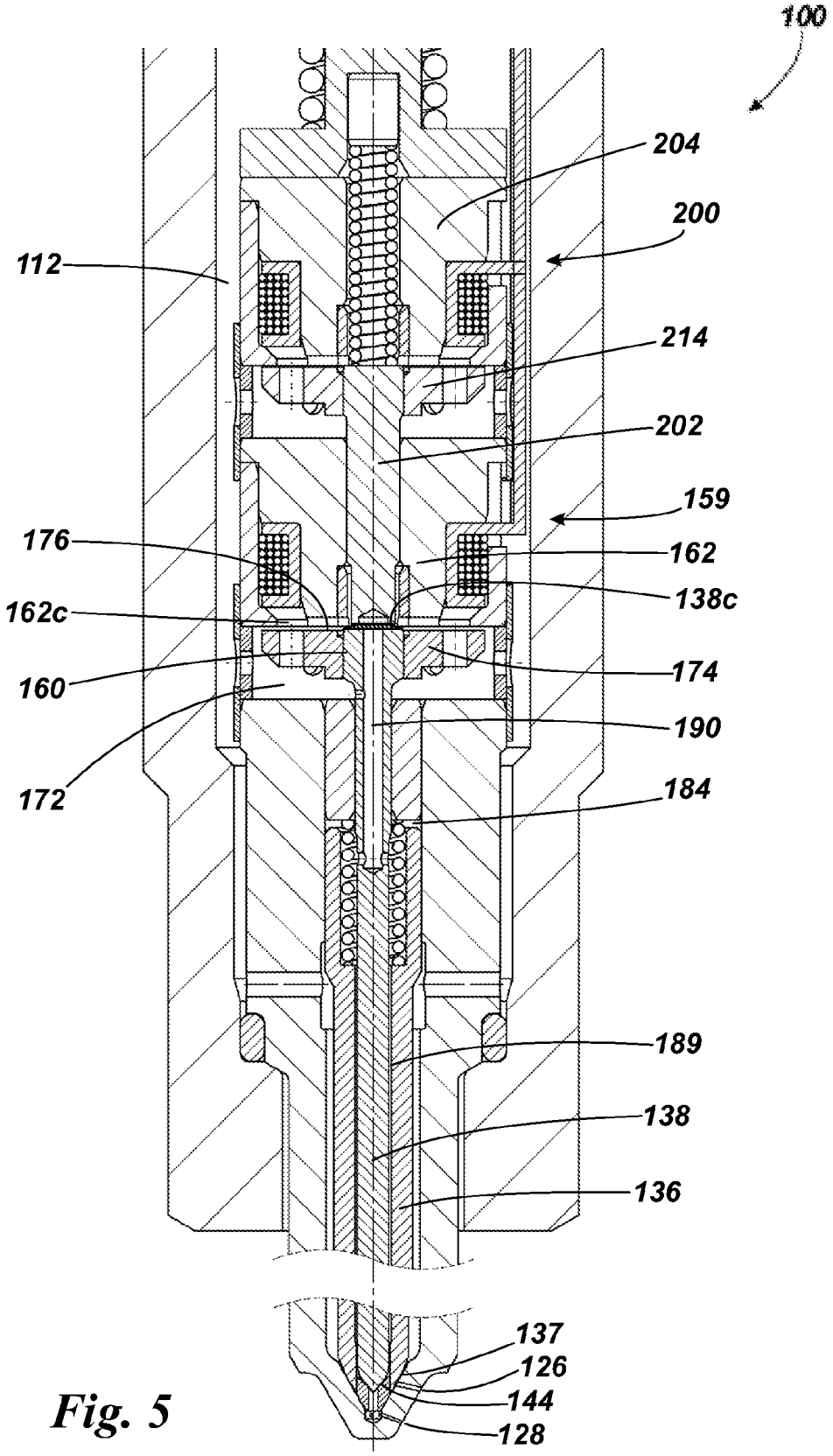
FIG. 5 shows the fuel injector of FIGS. 3 and 4 in a preparatory operational mode in which no injection takes place.

FIG. 5 shows the fuel injector in a condition in which the inner and outer valve needles 136, 138 are both engaged with their respective seating surfaces 137, 144. However, the injector 100 is in a preparatory condition to ensure that only the inner valve needle lifts in a subsequent injection operation. In order to ensure that that only the inner valve needle 138 lifts away from the inner seat region 144, only the second actuator arrangement 200 is energised, which attracts the second armature 214 towards the core member 204 thereby lifting the valve member 202 away from the upper end face 138*c* of the inner valve needle 138. This opens the fuel flow path from the volume 172 past the upper face 176 of the first armature 174 and into the drilling 190 of the inner valve needle 136. It should be noted that the passage of between the armature 174 and the core member 162 is facilitated by a slot arrangement 162*c* provided in its underside surface opposing the armature 174.

In order to reduce or minimise the force required to lift the inner valve needle 138, the inner seat region 144 provided by the insert member 146 is suitably of a small diameter, for example less than 0.5 mm. The insert member 146 is therefore advantageous in that it enables flexibility in the size of the seating region since it can be readily replaced by an alternative insert member.

Figure 6:
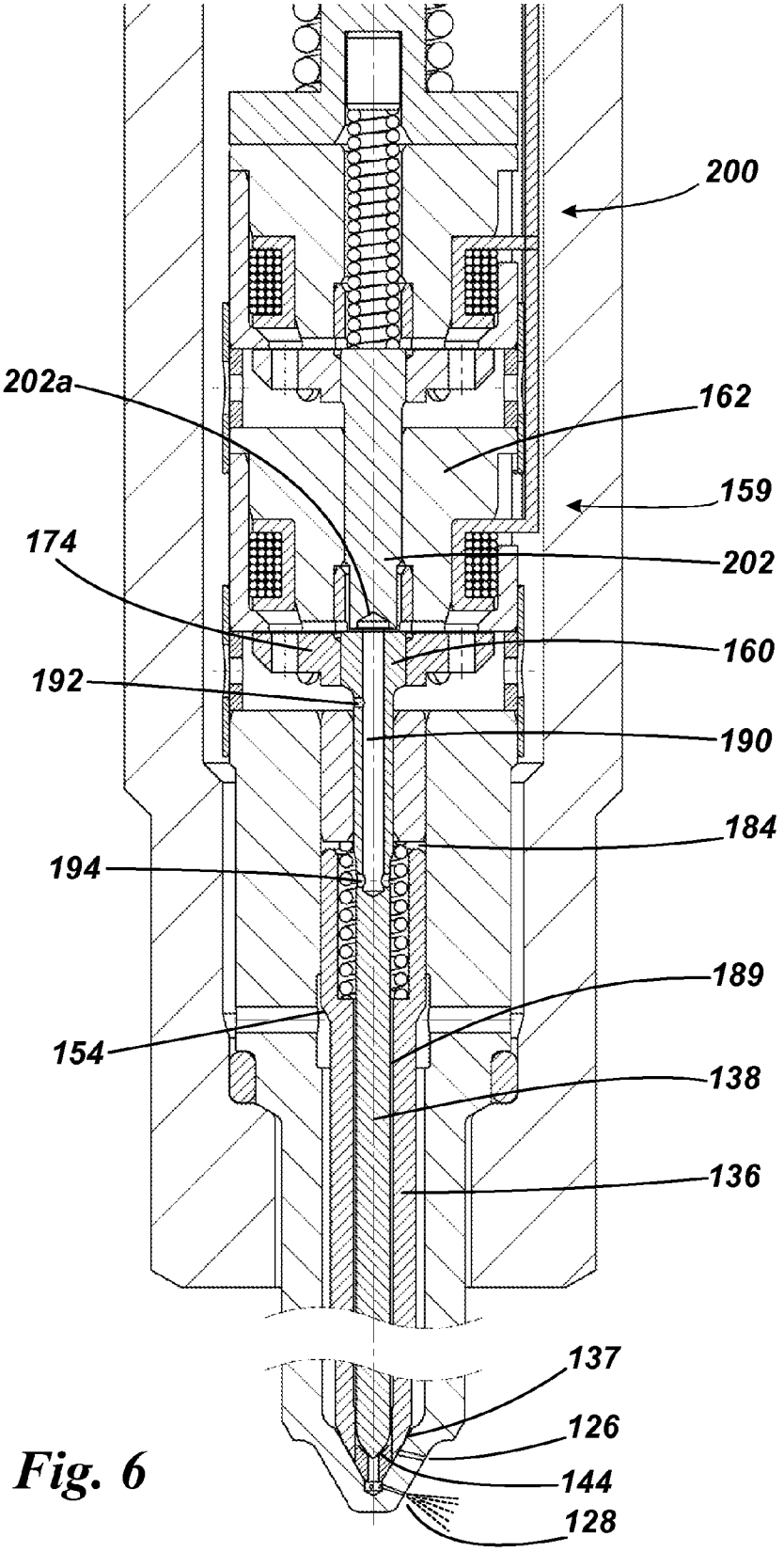
FIG. 6 shows the fuel injector of FIGS. 3 and 4 in a first fuel injecting mode in which the first valve member is actuated to inject fuel through a first set of nozzle outlets.

As shown in FIG. 6, in order to deliver fuel through the inner set of outlets 128, the first actuator arrangement 159 is energised which attracts the first armature 174 towards the core member 162. Since the end portion 160 of the inner valve needle 138 is coupled mechanically to the armature 174, the tip region 142 of the inner valve needle 138 is lifted away from the inner seat region 144. Fuel is therefore able to flow from the control chamber 184 along the annular channel 189 past the inner seat region 144 and through the second set of outlets 128.

Whilst fuel delivery is taking place through the second set of outlets 144, fuel is also flowing into the control chamber 184 via two paths: firstly through the lateral drilling 192, axial drilling 190 and radial passages 194 and also into the axial drilling 190 through its open end at the upper end 160 of the inner valve member 138 past the sealing end 202*a* of the valve member 202.

It should be appreciated that the dimension of the two flow paths are sized appropriately such that the flow rate of fuel into the control chamber 184 substantially matches the flow rate of fuel out of the control chamber 184. Therefore, the control chamber 184 experiences negligible pressure drop so that the net force acting on the outer valve member 136 due to the pressure of fuel within the control chamber 184, in addition to the spring force, and the force acting on the thrust surface 154 remains within limits to ensure the outer valve needle 136 remains seated and, thus, that no fuel delivery occurs through the upper nozzle outlets 126.

Figure 7:
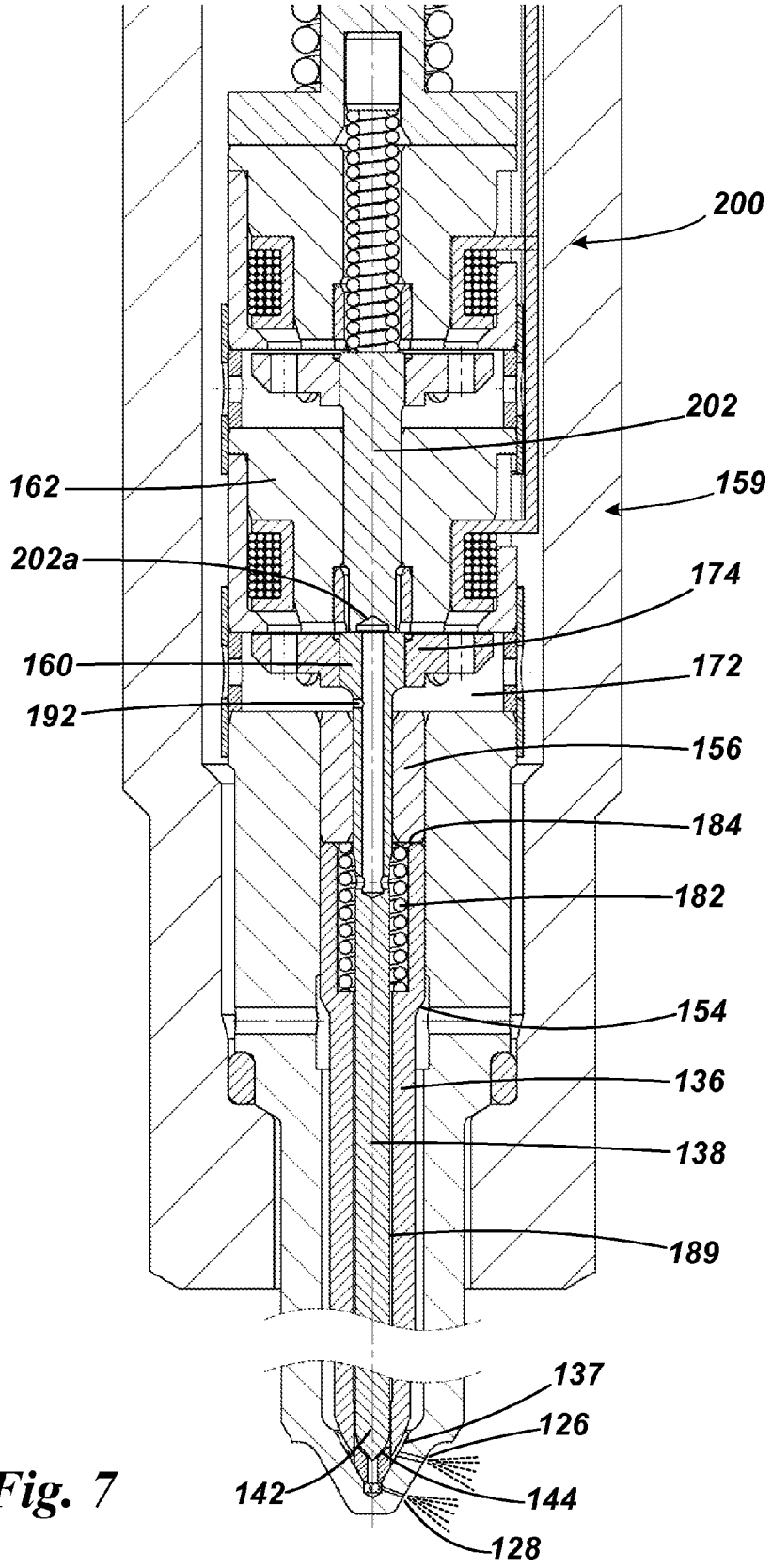
FIG. 7 shows the fuel injector of FIGS. 3 and 4 in a second fuel injecting mode, in which the first and second valve members are actuated to inject fuel through first and second sets of nozzle outlets.

FIG. 7 shows the injector in a condition in which both the outer valve needle 136 and inner valve needle 138 are lifted from their respective seat regions 137, 144 such that fuel injection takes place through the first and second sets of outlets 126, 128 at the same time. In this operational mode, only the first actuator arrangement 159 is energised, whereas the second actuator 200 remains de-energised.

In order to begin injection through the inner set of outlets 128, the first actuator arrangement 159 is energised which attracts the first armature 174 towards the core member 162. Since the end portion 160 of the inner valve needle 138 is coupled directly to the armature 174, the tip region 142 of the inner valve needle 138 is lifted away from the inner seat region 144 immediately, and fuel is therefore able to flow from the control chamber 184 along the annular channel 189 and through the second set of outlets 144.

Since the second solenoid arrangement 200 is not energised, the sealing end 202*a* of the valve member 202 remains engaged with the end portion 160 of the inner valve needle 138 as it lifts away from its seating region 144. Therefore, pressurised fuel in the volume 172 can only flow into the control chamber 184 through the restricted drilling 192. As a result, the pressure of fuel within the control chamber 184 will drop rapidly thereby reducing the corresponding closing force on the acting on the outer valve needle 136. A point will be reached at which the pressure of fuel in the injector chamber 112 acting on the thrust surface 154 of the outer valve needle 136 will be greater than the opposing force due to the spring 182 and due to the fuel pressure within the control chamber 184, at which point the outer valve needle 136 also lifts away from the its seating region 137 to permit fuel delivery through the first set of outlets. This is the position of the inner and outer valve needles shown in FIG. 7. Note that the maximum lift position of the outer valve needle 136 occurs when the upper end of the outer valve needle 136 comes into contact with the plug member 156.

In this injection mode, the "servo" flow of fuel out of the control chamber 184 that is necessary to open the outer valve needle 136 is injected directly into a cylinder of the engine, rather than being directed to a low pressure fuel drain, as is the case in the prior art. As a result, start of injection occurs very quickly in a manner akin to a direct acting piezoelectric injector. Furthermore, the "servo" flow of fuel is not wasted which makes the injector of the invention more energy efficient.

It will be appreciated that in the injection event described with reference to FIG. 7, fuel delivery first occurs through the second set of nozzle outlets 128 and then, subsequently, through the first set of nozzle outlets 126. As a result of this, the delivery rate rises from a relatively low initial rate to a greater delivery rate in what is sometimes referred to as a 'boot-shaped' profile. It has been observed that such a profile provides combustion and emission benefits.

The rate at which the pressure falls in the control chamber 184 is controlled by appropriate sizing of the drillings 190, 192 and 194 in the inner control needle 138. So, for example, the drillings may be sized such that the time taken for the control chamber pressure to drop sufficiently to lift the outer valve needle is longer than the time necessary to perform pilot injection events or post injection events, or even engine idle main injection events. So, the fact that movement of the inner valve needle 138 is controlled directly via the armature permits precise injection quantity control of particularly small injection events and, moreover, closely spaced injection events can be achieved.

Furthermore, the invention enables the operation of the outer valve needle 136 to be selectively disabled so that inadvertent injection through the first set of nozzle outlets 126 cannot occur.

Figure 8:
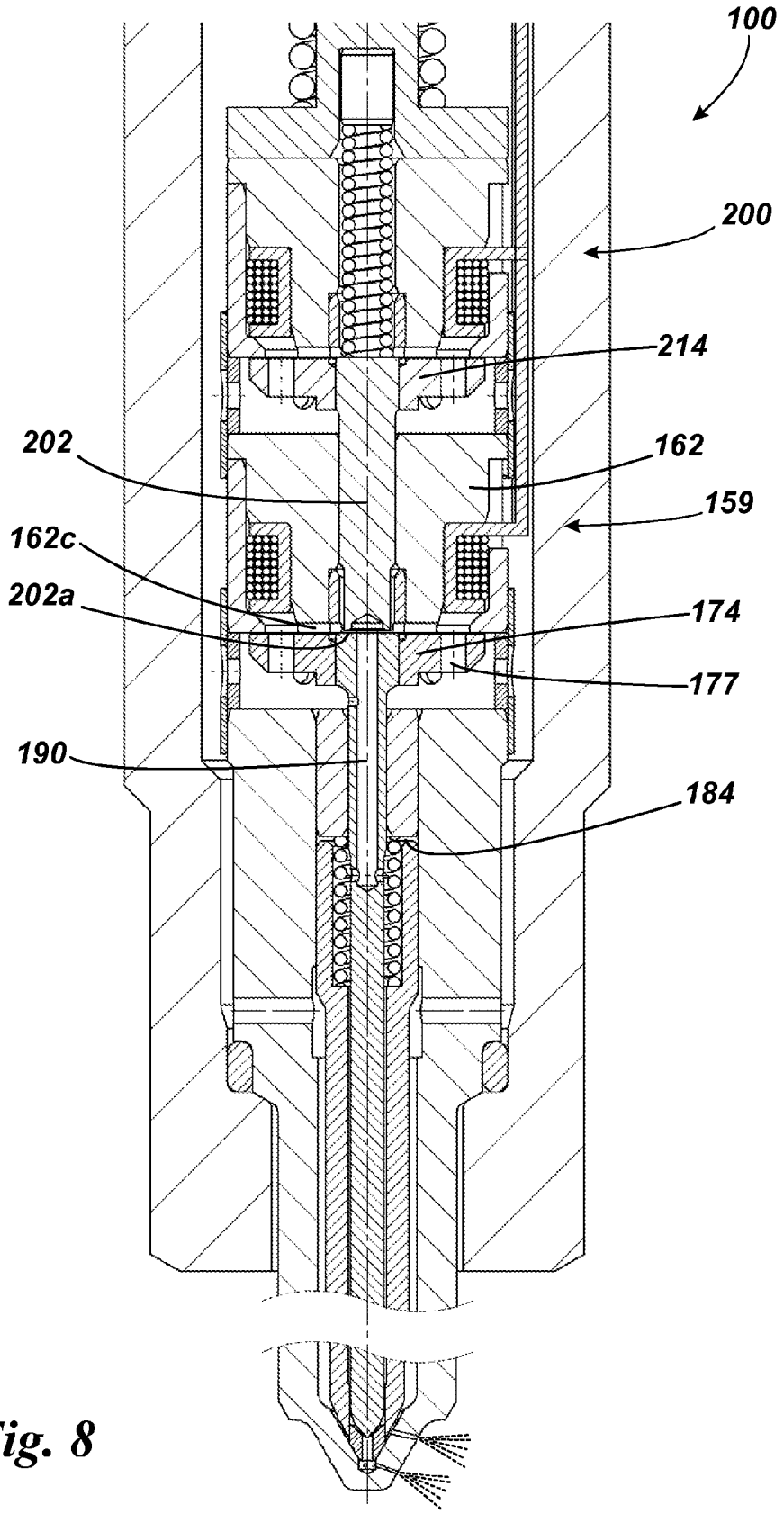
FIG. 8 shows the fuel injector of FIGS. 3 and 4 in the second fuel injection mode as in FIG. 7 but operated so as to achieve a rapid termination of fuel delivery.

FIG. 8 illustrates an advantageous technique that may be applied to the injector 100 having a condition depicted in FIG. 7 in which both the inner and outer valve needles 138, 136 are disengaged from their respective seating regions 144, 137, by virtue of the first actuator arrangement 159 being energised and the second actuator arrangement 200 being de-energised, in order to achieve a rapid termination of injection, which is desirable to avoid excessive exhaust emissions.

As an initial step, the second actuator arrangement 200 is energised which moves the second armature 214 axially thus disengaging the sealing end 202*a* of the valve member 202 from the end portion 160 of the inner valve needle 138. As a result, fuel is permitted to flow from the volume 172, through the vent holes 177 and slot arrangement 162*c*, past the sealing end 202*a* of the valve member 202 and into the axial drilling 190 and control chamber 184. The control chamber 184 is therefore re-pressurised which re-establishes a sufficient closing force onto the outer valve needle 136 that is thus caused to close.

At a predetermined time after energisation of the second actuator arrangement 200, the first actuator arrangement 159 is de-energised which causes the inner valve needle 138 to re-engage the inner seat region 144 substantially simultaneously with the outer valve needle 136.

Once the inner valve needle 138 and the outer valve needle 136 are engaged with their respective seat regions 144, 137, the second actuator arrangement 200 is de-energised which re-seats the valve member 202 against the end portion 160 of the inner valve member 138 therefore returning the injector to the condition shown in FIG. 4. It is also possible for the second actuator arrangement 200 to be de-energised before the inner valve needle 138 and the outer valve needle 136 are engaged with their respective seat regions 144, 137, i.e. while the valve needles are still closing, because of the response time of the actuator. Shortening the energisation time in this way beneficially reduces power consumption.

It should be appreciated that modifications may be made to the embodiments described above without departing from the scope of the invention as defined by the appended claims. For example, the choice of actuator for use within the fuel injector of the invention, the exact mechanism for the direct coupling between the actuator and the inner valve needle, and the arrangement of the nozzle outlets may be decided upon on a case-by-case basis and are encompassed by the invention.

Furthermore, it will be noted that the inner valve needle 138 has been described as a unitary member that extends from the tip region 142 to the end portion 160 that projects out of the plug member 156. However, this need not be the case and instead the inner valve needle 138 may be comprised of two or more parts suitably joined, for example by screw thread or welding which may be beneficial for manufacturing.

The invention claimed is:

1. A fuel injector for use in an internal combustion engine, the fuel injector comprising:

an injection nozzle having a nozzle body provided with a nozzle bore;

a first valve needle received within the nozzle bore and engageable with a first seat region to control fuel delivery through a first set of nozzle outlets;

a second valve needle received within a valve bore provided in the first valve needle and engageable with a second seat region arranged to control fuel delivery through a second set of nozzle outlets;

a control chamber for fuel, wherein movement of the first valve needle is coupled to fuel pressure in the control chamber, and wherein movement of the second valve needle is mechanically coupled to an armature of a first actuator arrangement, such that when the second valve needle lifts away from the second seating region, a fuel flow path is established between the control chamber and the second set of nozzle outlets;

the injector further including a second actuator arrangement that is operable to control fuel flow into the control chamber thereby regulating fuel pressure within the control chamber and, thus, movement of the first valve needle.

2. The fuel injector of claim 1, wherein the second valve needle is provided with a fuel flow passage to permit fuel to flow from an accumulator volume to the control chamber.

3. The fuel injector of claim 2, wherein the second valve needle is a unitary component.

4. The fuel injector of claim 2, wherein the second actuator arrangement includes a valve member that is engagable with a seating surface associated with the second valve needle in order to control fuel flow from the accumulator volume into an axial passage of the fuel flow passage.

5. The fuel injector of claim 4, wherein, in use, fuel from the control chamber is delivered through the second set of nozzle outlets causing fuel pressure within the control chamber to reduce, and when the pressure of fuel within the control chamber has reduced to a predetermined low pressure, the first valve needle is caused to disengage the first seat region to allow delivery of fuel through the first set of nozzle outlets.

6. The fuel injector of claim 4, wherein the second actuator arrangement is operable to disengage the valve member from the seating surface thereby providing for fuel flow from the accumulator volume to the control chamber to ensure that the first valve needle does not disengage from the first seat region.

7. The fuel injector of claim 1, wherein a plug member is received in the nozzle bore such that the control chamber is defined, at least in part, by a surface of the plug member and a recess provided in the first valve needle.

8. The fuel injector of claim 7, wherein the plug member includes an aperture for slidably receiving a part of the second valve needle.

9. The fuel injector as claimed claim 1, including an valve seat member received at a blind end of the nozzle bore and which provides the second seat region for the second valve needle.

10. The fuel injector of claim 1, wherein the second actuator arrangement is an electromagnetic actuator arrangement having a second armature associated therewith.

11. A method of operating an injector as claimed in claim 1, including, in a first fuel injection mode:

i) activating the second actuator arrangement prior to an injection event so as to provide a substantially unrestricted fuel flow path into the control chamber, and ii) activating the first actuator arrangement in order to deliver pressurised fuel through the first set of nozzle outlets.

12. The method of claim 11, further including, in a second injecting mode:

iii) holding the second actuator arrangement in a de-activated state to provide a restricted flow path for fuel to the control chamber, iv) activating the first actuator arrangement in order to deliver pressurised fuel through the first set of nozzle outlets, v) activating the second actuator arrangement, a predetermined amount of time after activation of the first actuator arrangement, in order to engage the first valve needle with the first seat region, and vi) deactivating the first actuator arrangement a predetermined amount of time after activating the second actuator arrangement in order to engage the second valve needle with the second seat region at substantially the same time as the first valve needle engages with the first seat region.

13. The fuel injector of claim 3, wherein the second actuator arrangement includes a valve member that is engageable with a seating surface associated with the second valve needle in order to control fuel flow from the accumulator volume into an axial passage of the fuel flow passage.

14. The fuel injector of claim 13, wherein, in use, fuel from the control chamber is delivered through the second set of nozzle outlets causing fuel pressure within the control chamber to reduce, and when the pressure of fuel within the control chamber has reduced to a predetermined low pressure, the first valve needle is caused to disengage the first seat region to allow delivery of fuel through the first set of nozzle outlets.

15. The fuel injector of claim 14, wherein the second actuator arrangement is operable to disengage the valve member from the seating surface thereby providing for fuel flow from the accumulator volume to the control chamber to ensure that the first valve needle does not disengage from the first seat region.

16. The fuel injector of claim 13, wherein the second actuator arrangement is operable to disengage the valve member from the seating surface thereby providing for fuel flow from the accumulator volume to the control chamber to ensure that the first valve needle does not disengage from the first seat region.

17. The fuel injector of claim 5, wherein the second actuator arrangement is operable to disengage the valve member from the seating surface thereby providing for fuel flow from the accumulator volume to the control chamber to ensure that the first valve needle does not disengage from the first seat region.

* * * * *